US011859816B2

(12) United States Patent
Nair et al.

(10) Patent No.: US 11,859,816 B2
(45) Date of Patent: Jan. 2, 2024

(54) SYSTEMS AND METHODS FOR SUPPRESSING THERMO-ACOUSTIC INSTABILITIES IN A COMBUSTOR

(71) Applicant: Indian Institute of Technology Madras (IIT Madras), Chennai (IN)

(72) Inventors: Sujith Raman Indusekharan Pillai Nair, Chennai (IN); Krishna Manoj, Chennai (IN); Samadhan Ananda Pawar, Chennai (IN); Abin Krishnan, Chennai (IN); Midhun Palakkal Raghunath, Chennai (IN); Reeja Kunnathu Valappil, Chennai (IN); Manikandan Raghunathan, Chennai (IN); Amitesh Roy, Chennai (IN)

(73) Assignee: INDIAN INSTITUTE OF TECHNOLOGY, MADRAS (IITM), Chennai (IN)

( * ) Notice: Subject to any disclaimer, the term of this patent is extended or adjusted under 35 U.S.C. 154(b) by 659 days.

(21) Appl. No.: 17/061,298

(22) Filed: Oct. 1, 2020

(65) Prior Publication Data

US 2021/0095848 A1 Apr. 1, 2021

(30) Foreign Application Priority Data

Oct. 1, 2019 (IN) ..... 201941039838
Oct. 29, 2019 (IN) ..... 201941043800

(51) Int. Cl.
*F23N 5/16* (2006.01)

(52) U.S. Cl.
CPC ..... *F23N 5/16* (2013.01)

(58) Field of Classification Search
CPC ..... F23N 5/16
USPC ..... 431/114
See application file for complete search history.

(56) References Cited

U.S. PATENT DOCUMENTS

2003/0074902 A1* 4/2003 Wilson ..... F02C 5/00 60/725
2017/0115004 A1* 4/2017 Baramov ..... F23N 1/002

* cited by examiner

*Primary Examiner* — Vivek K Shirsat

(57) ABSTRACT

Various kinds of oscillatory instabilities are seen in practical systems. We devise of way of combating these oscillatory instabilities in a thermoacoustic system. Confined combustion environments are prone to large amplitude pressure oscillations known as thermoacoustic instabilities. Although several techniques have been employed to control or mitigate such instabilities, optimization of these methods is achieved at the cost of performing multiple trial and error experiments/simulations. This invention develops a methodology to quantify the spatio-temporal dynamics using synchronization, recurrence, and fractal measures and find the coherent region in such turbulent flow field. Such an analysis provides us with a novel way to detect critical regions responsible for thermoacoustic instability, and other oscillatory instabilities in general, in the flow field and implement an optimized control strategy at these regions.

18 Claims, 12 Drawing Sheets

300

400

500

700

800

900

1000

1100

SYSTEMS AND METHODS FOR SUPPRESSING THERMO-ACOUSTIC INSTABILITIES IN A COMBUSTOR

TECHNICAL FIELD

The present invention seeks to solve the problem of thermoacoustic instability observed in gas turbine combustors. The combustion chambers in gas turbine engines are prone to large amplitude, self-sustained periodic pressure oscillations. These oscillations arise inside the combustor due to a positive feedback between the acoustics of the combustor and the oscillatory heat release rate taking place inside the combustion chamber. The present invention mainly focusses on the suppression of the undesirable fluid mechanic instabilities namely thermoacoustic instability, in turbulent combustor. The present application is based on, and claims priority from an Indian Application Number 201941039838 filed on 1 Oct. 2019 and Indian Application number 201941043800 filed on 29 Oct. 2019, the disclosure of which is hereby incorporated by reference herein.

BACKGROUND

Turbulent flows are prone to oscillatory instability where large amplitude periodic oscillations are observed in the system variable. One such example is that of gas turbine combustors which when operated in lean conditions, undergo large amplitude, self-sustained pressure oscillations known as thermoacoustic instability. Thermoacoustic instability develops through a coupling between acoustic pressure and heat release rate fluctuations inside the combustion chamber. These oscillations are highly detrimental to the life of combustor parts as it can cause extensive damage through excessive heat transfer, and wear and tear due to vibration.

Self-organization is a property of complex systems where the interaction between the subparts of the system leads to an emergent phenomenon or a coherent pattern in the spatial or temporal dynamics of the system. An example of such a complex fluid-mechanic system is a thermoacoustic system, where the interaction of the acoustic field of the confinement with the turbulent reacting fluid in it leads to the formation of self-sustained large-scale vertical structures during the state of thermoacoustic instability. The onset of such instabilities leads to a significant growth in the amplitude of the acoustic vibrations in the combustion system, leading to various catastrophic consequences such as breaking of mechanical and electronic parts, wear and tear of components causing fatigue failure, loss of system performance, and ultimately the failure of the mission.

Thence, there exists a necessity to invent or develop effective smart control strategies that can mitigate thermoacoustic instability upon its onset. Several control strategies have been developed over the years, which includes the usage of acoustic dampers and liners, staged fuel injection, microjet injections etc. The implementation of these methods requires considerable modifications in the hardware of the combustor. Therefore, the effectiveness of these methodologies to either control or mitigate thermoacoustic instability requires identification of critical regions in the combustor where these controls can be installed Passive control is usually achieved by: (1) modifying combustor geometry to change the relative phase of acoustic modes and HRR oscillations, (2) altering fuel injection mechanism to change the HRR distribution inside the combustor, (3) installing baffles and Helmholtz resonators to remove acoustic energy and (4) applying acoustic liners.

Active control strategies involves supplying energy to the thermoacoustic system through dynamic actuators. Active control is further divided into active closed-loop and open-loop control. In active control, the combustor is monitored in real-time using sensors and actuators are controlled based on the state of the system. In contrast, there is no feedback required for open-loop control.

Active open-loop control is achieved by: (1) forcing the combustor at a frequency which is different from the frequency of limit cycle oscillations, (2) secondary fuel-air injection, or (3) applying swirl on an otherwise static swirler.

Active closed-loop control is achieved by altering some system parameter depending upon the state of the system determined on-the-fly. Loudspeakers and fuel valve actuators are used to force the system. Generally, fuel-air flow rate is modulated at some frequency and amplitude which is determined based on the state of the system. The choice of frequency and amplitude is based on principles of optimality, robustness and intelligence. Controllers developed earlier were based on phase-shifts and time-delays, but were later proved to be inaccurate.

Thus, there exists a necessity to invent or develop effective smart control strategies that can mitigate thermoacoustic instability upon its onset. Thermoacoustic instability is generally solved through passive and active control strategies. As active control strategies are still under development, passive control strategies are deployed to cope with thermoacoustic instability. Passive control of thermoacoustic instability is achieved by disrupting the phase relationship between acoustic pressure and heat release rate (HRR) oscillations, and/or increasing damping in the combustor.

OBJECT OF THE DISCLOSURE

The present invention aims to design a smart and informed control strategy to combat various types of oscillatory instabilities by devising measures based on the physics of the flow-field. Control is then achieved by disturbing these so called "critical regions" in the flow field. These critical regions represent zones of coherent dynamics of the flow field of the combustor and hence, the application of control strategy, at these zones, result in maximum suppression of these instabilities. Therefore, the identification of such critical regions and the implementation of smart control delivers an operator friendly technique for the effective suppression of instabilities and provides many financial incentives by reducing costs related to testing.

SUMMARY

Embodiments of the present disclosure are directed to method for suppressing thermo-acoustic instabilities in a combustor. The method comprises generating at least one first signal corresponding to fluctuations in turbulent velocity of the combustor at every location of the combustor, generating at least one second signal corresponding to fluctuations in acoustic pressure of the combustor at least one location of the combustor, determining a plurality of phase locked values across the combustor indicative of synchronization of the at least one first signal corresponding to turbulent velocity of the combustor and the at least one second signal corresponding to acoustic pressure of the combustor, measuring parameters indicative of a plurality of recurring behavior of fluctuations, including recurrence rate, determinism, entropy, trapping time, and average diagonal length, using the turbulent velocity of the combustor at every location of the combustor, determining a plurality of Hurst exponent values at every location of the combustor based on the at least one first signal, detecting at least one critical region of the combustor, wherein the at least one critical region corresponds to at least one of a maximum value of the plurality of phase locked values, a maximum value of the plurality of recurring fluctuations in turbulent velocity of the combustor at every location of the combustor, and a minimum value of the plurality of Hurst exponent values and injecting micro-jets of air at the detected critical regions to suppress thermo-acoustic instabilities.

Another embodiment of the present disclosure is directed to determining an instantaneous phase difference of each of the at least one first signal and the at least one second signal using Hilbert transform and determining the phase looking value between the at least one first signal and the at least one second signal based on the determined phase difference.

Another embodiment of the present disclosure is directed to the plurality of phase locked values across the combustor correspond to a correlation between the turbulent velocity at every location of the combustor with the acoustic pressure of the combustor.

Another embodiment of the present disclosure is directed to the plurality of phase locked values across the combustor correspond to a correlation between the turbulent velocity at every location of the combustor with the acoustic pressure of the combustor.

Another embodiment of the present disclosure is directed to the phase locked value being characterized by a value close to one when the phase difference is constant and values lower than one when the phase difference continuously drifts with time.

Another embodiment of the present disclosure is directed to measuring parameters indicating recurring behavior of fluctuations, including recurrence rate, determinism, entropy, trapping time, and average diagonal length, in turbulent velocity of the combustor at every location of the combustor including measuring values indicative of recurrence rate, entropy, trapping time, and average diagonal length.

Another embodiment of the present disclosure is directed to measuring a Euclidian distance between state points of the phase space trajectory at every location on the combustor and determining a recurring fluctuation based on the Euclidian distance being above a threshold.

Another embodiment of the present disclosure is directed to the at least one critical region of the combustor being detected at a region spanning from a dump plane of the combustor to a buff body of the combustor.

Embodiments of the present disclosure are directed to a system for suppressing thermo-acoustic instabilities in a combustor. The system includes a measuring device configured to generate at least one first signal corresponding to fluctuations in turbulent velocity of the combustor at every location of the combustor and at least one second signal corresponding to fluctuations in acoustic pressure of the combustor at least one location of the combustor, a phase locked value generator configured to determine a plurality of phase locked values across the combustor indicative of synchronization of the at least one first signal corresponding to turbulent velocity of the combustor and the at least one second signal corresponding to acoustic pressure of the combustor, a determinism unit configured to measure parameters indicative of a plurality of recurring fluctuations in turbulent velocity of the combustor at every location of the combustor, a Hurst exponent scaler configured to determine a plurality of Hurst exponent values at every location of the combustor based on the at least one first signal and a critical region detector configured to detect at least one critical region of the combustor, wherein the at least one critical region corresponds to at least one of a maximum value of the plurality of phase locked values, a maximum value of the plurality of recurring fluctuations in turbulent velocity of the combustor at every location of the combustor, and a minimum value of the plurality of Hurst exponent values, wherein micro-jets of air are injected at the detected critical regions to suppress thermo-acoustic instabilities.

BRIEF DESCRIPTION OF THE FIGURES

This invention is illustrated in the accompanying drawings, throughout which like reference letters indicate corresponding parts in the various figures. The embodiments herein will be better understood from the following description with reference to the drawings, in which.

DETAILED DESCRIPTION OF INVENTION

Figure 1:
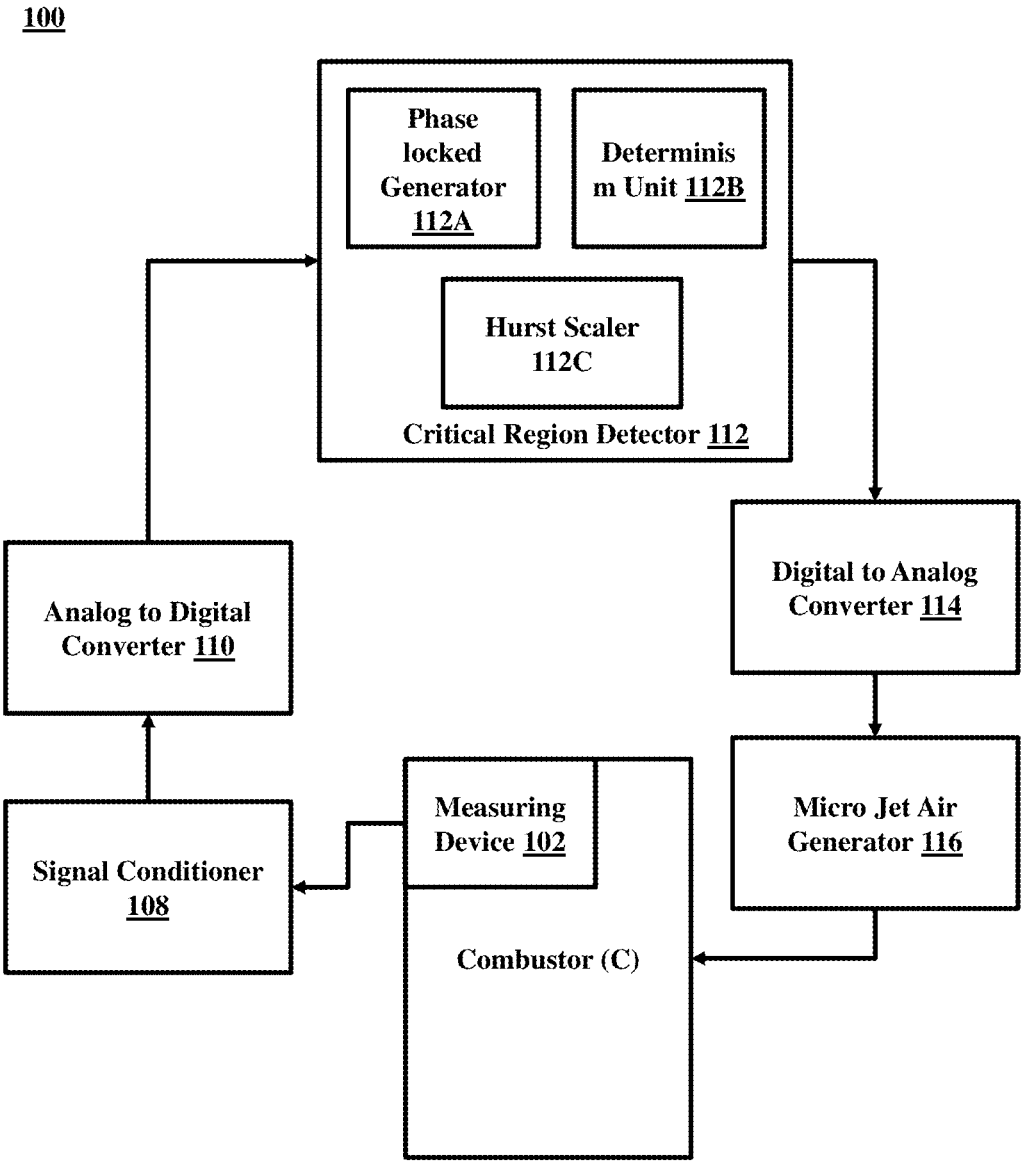
FIG. 1 illustrates a system for suppressing thermo-acoustic instabilities in a combustor, according to embodiments as disclosed herein.

Various embodiments of the present disclosure will now be described in detail with reference to the accompanying drawings. In the following description, specific details such as detailed configuration and components are merely provided to assist the overall understanding of these embodiments of the present disclosure. Therefore, it should be apparent to those skilled in the art that various changes and modifications of the embodiments described herein can be made without departing from the scope and spirit of the present disclosure. In addition, descriptions of well-known functions and constructions are omitted for clarity and conciseness.

Also, the various embodiments described herein are not necessarily mutually exclusive, as some embodiments can be combined with one or more other embodiments to form new embodiments. Herein, the term "or" as used herein, refers to a non-exclusive or, unless otherwise indicated. The examples used herein are intended merely to facilitate an understanding of ways in which the embodiments herein can be practiced and to further enable those skilled in the art to practice the embodiments herein. Accordingly, the examples should not be construed as limiting the scope of the embodiments herein. Further it should be possible to combine the flows specified in different figures to derive a new flow.

As is traditional in the field, embodiments may be described and illustrated in terms of blocks which carry out a described function or functions. These blocks, which may be referred to herein as managers, engines, controllers, units or modules or the like, are physically implemented by analog and/or digital circuits such as logic gates, integrated circuits, microprocessors, microcontrollers, memory circuits, passive electronic components, active electronic components, optical components, hardwired circuits and the like, and may optionally be driven by firmware and software. The circuits may, for example, be embodied in one or more semiconductor chips, or on substrate supports such as printed circuit boards and the like. The circuits constituting a block may be implemented by dedicated hardware, or by a processor (e.g., one or more programmed microprocessors and associated circuitry), or by a combination of dedicated hardware to perform some functions of the block and a processor to perform other functions of the block. Each block of the embodiments may be physically separated into two or more interacting and discrete blocks without departing from the scope of the disclosure. Likewise, the blocks of the embodiments may be physically combined into more complex blocks without departing from the scope of the disclosure.

The embodiments herein and the various features and advantageous details thereof are explained more fully with reference to the non-limiting embodiments that are illustrated in the accompanying drawings and detailed in the following description.

The embodiments disclosed herein can be implemented through at least one software program running on at least one hardware device and performing network management functions to control the elements. The elements shown in FIGS. 1-12 include blocks which can be at least one of a hardware device, or a combination of hardware device and software module.

Reference in this specification to "one embodiment" or "an embodiment" means that a particular feature, structure, or characteristic described in connection with the embodiment is included in at least one embodiment of the present technology. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described, which may be requirements for some embodiments but no other embodiments.

Moreover, although the following description contains many specifics for the purposes of illustration, anyone skilled in the art will appreciate that many variations and/or alterations to said details are within the scope of the present technology. Similarly, although many of the features of the present technology are described in terms of each other, or in conjunction with each other, one skilled in the art will appreciate that many of these features can be provided independently of other features. Accordingly, this description of the present technology is set forth without any loss of generality to, and without imposing limitations upon, the present technology.

This invention is based on the analysis of velocity field which can be acquired from the combustor from PIV experiments or from high fidelity simulations.

FIG. 1 illustrates a block diagram of a system 100 for suppressing thermo-acoustic instabilities in a combustor, according to embodiments as disclosed herein. In an embodiment, the system 100 is configured to detect and suppress thermo-acoustic instabilities in devices such as combustors (C) in gas turbines, and industrial processing devices such as furnaces and burners. However, it is also within the scope of invention, that the system 100 could be used for any other device that encounters unwanted thermo-acoustic instabilities at every location of the combustor.

In an embodiment, the measuring device 102 is configured to acquire acoustic signals corresponding to the dynamics happening inside the combustor (C). In an embodiment, the measuring device 102 is provided in communication with the combustor (C) or any other device that has to be prevented from oscillatory instabilities. The measuring device 100 is configured to generate at least at least one first signal corresponding to fluctuations in turbulent velocity of the combustor at every location of the combustor and at least one second signal corresponding to fluctuations in acoustic pressure of the combustor at least one location of the combustor.

In another embodiment, the system 100 also includes a signal conditioner 108, an analog to digital convertor 110 and a digital to analog convertor 114. The signal conditioner 108 is configured to manipulate the signals (c/(j)) generated by the measuring device 102, such that it meets the requirements of analog to digital convertor 110. In an embodiment, the signal conditioner 108 is configured to amplify the signals generated by the measuring device 102. Further, if the signals obtained from the measuring device 102 is analog, the analog to digital convertor 110 coverts the analog signal to digital signal such that the signals (c/(j)) could be processed in the instability detection unit 104. Further, the digital to analog convertor 114 converts the digital signal obtained as the output from the critical region detector 112 to an analog signal such that it could be processed by the micro jet air generator 116.

A phase locked generator 112A is configured to determine a plurality of phase locked values across the combustor indicative of synchronization of the at least one first signal corresponding to turbulent velocity of the combustor and the at least one second signal corresponding to acoustic pressure of the combustor. A determinism unit 112B is configured for measuring parameters indicative of a plurality of recurring fluctuations in turbulent velocity of the combustor at every location of the combustor. A Hurst scaler 112C determines a plurality of Hurst exponent values at every location of the combustor based on the at least one first signal. The critical region detector 112 detects at least one critical region of the combustor, wherein the at least one critical region corresponds to at least one of a maximum value of the plurality of phase locked values, a maximum value of the plurality of recurring fluctuations in turbulent velocity of the combustor at every location of the combustor, and a minimum value of the plurality of Hurst exponent values. Upon detecting the critical regions, the micro jet air generator 114 injects micro-jets of air at the detected critical regions to suppress thermo-acoustic instabilities.

It should be noted that the aforementioned configuration of system 100 is provided for the ease of understanding of the embodiments of the invention. However, certain embodiments may have a different configuration of the components of the system 100 and certain other embodiments may exclude certain components of the system 100. Therefore, such embodiments and any modification by addition or exclusion of certain components of system 100 and without otherwise deterring the intended function of the system 100 as is apparent from this description and drawings are also within the scope of this invention.

The present invention is based on the analysis of spatiotemporal data of the combustor, which can be obtained from experiments or from high fidelity simulations. The spatial data are obtained at a particular instant of time in the form of images where every pixel (in experiment) or the grid point (in simulation) on the image contains information about the measured variable (i.e., acoustic pressure, velocity, local reaction rate, temperature, mixture fraction, vorticity etc). Therefore, the time evolution of the signals from these variables is obtained at each spatial location. The values of phase locked values (PLV) and determinism value (DET) are then computed for the time series acquired at each spatial location; thus, a spatial distribution of these quantities is obtained for the reaction field of the combustor. The coherent patterns in the reaction field with maximum value of measures indicate the critical regions of reaction field of the combustor.

Figure 2:
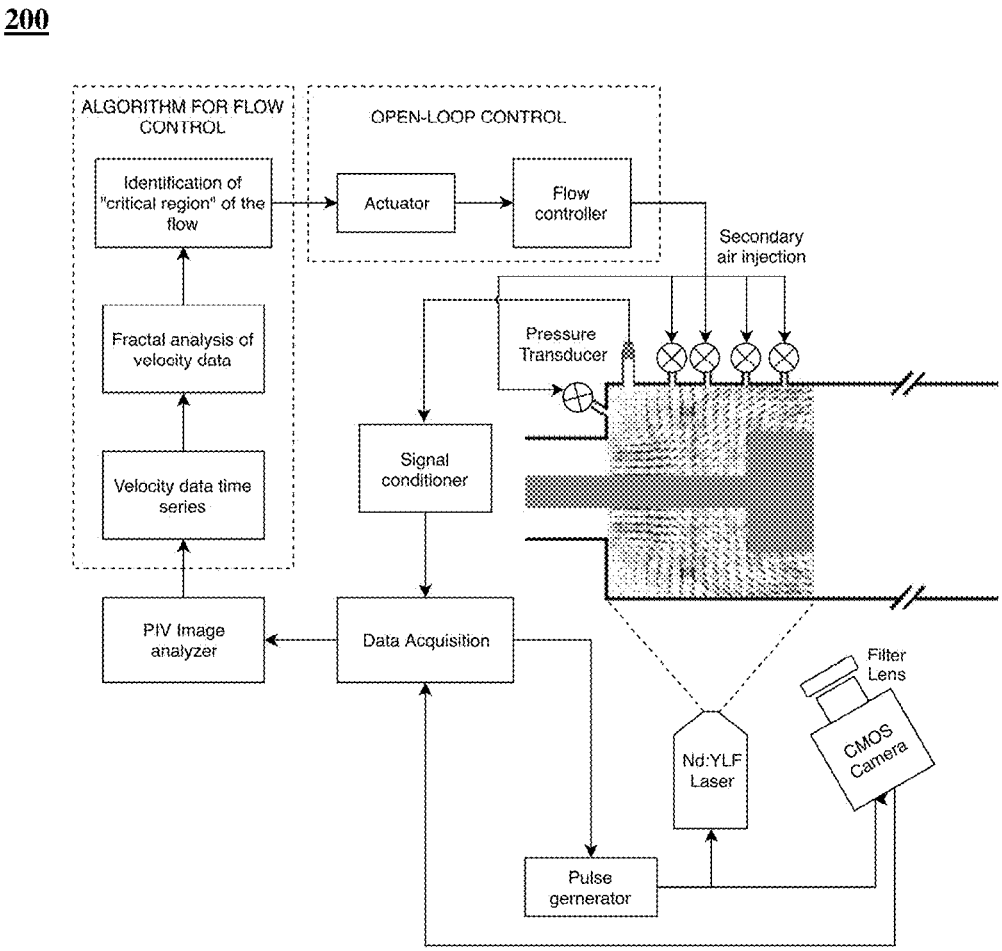
FIG. 2 illustrates the method of optimizing the open-loop or smart passive control strategy in a turbulent combustor, according to embodiments as disclosed herein.

FIG. 2 illustrates the method of optimizing the open-loop or passive control strategy in a turbulent combustor.

a. Calculation of Phase Locking Value of Coupled Oscillations

Phase locking value measures the synchronization behavior of two oscillators. Synchronization is a phenomenon of mutual adjustment of rhythms of oscillators to a common value due to coupling. The synchronization behavior of coupled oscillators is analyzed through the calculation of instantaneous phase difference between their signals. If the signals are synchronized, the relative phase between them remains constant in time, whereas, if the signals are desynchronized, the relative phase drifts unboundedly in time.

Consider $x_1(t)$ and $x_2(t)$, which are two bandpass filtered, in a frequency range of interest, signals from two independent variables of the system, then the instantaneous phase of each signal is obtained from the analytic signal approach based on Hilbert transform as follows:

$$(t)=x_k(t)+iHT[x_k(t)]$$

where $i=\sqrt{-1}$, k=1, 2, and HT is the Hilbert transform of the signal defined as:

$$HT[x_k(t)] = P.V.\int_{-\infty}^{\infty}\frac{x_k(t)}{t-\tau}d\tau$$

Here, P.V. represents the Cauchy principal value. Since, $Z_k(t)$ is a complex signal, the instantaneous amplitude and phase of the signal can be obtained as follows:

$$Z_k(t)=A(t)e^{i\phi(t)}$$

Where $$A(t) = \sqrt{[x_k(t)]^2 + [HT(x_k(t))]^2} \text{ and}$$

$$\phi(t) = \tan^{-1}\frac{HT(x_k(t))}{x_k(t)}$$

Therefore, the instantaneous phase difference between the signals is obtained as $\Delta\phi=\phi_1-\phi_2$ The phase locking value between the coupled oscillator signals is defined as:

$$PLV = \frac{1}{N}\left|\Sigma_{j=1}^{N}e^{j\Delta\phi}\right|$$

where N is the length of the signal, is then calculated. The value of PLV ranges from 0 (complete desynchrony) to 1 (perfect synchrony).

b. Calculation of Determinism in the Phase Space Trajectory

In dynamical systems theory, a one-dimensional signal can be projected into higher-dimensional phase space to reveal the hidden features associated with its dynamics. In practical situations, especially in experiments, where the number of independent variables obtained from the system is limited, the phase space of the given signal can be constructed using Takens delay embedding theorem. On the other hand, in simulations, the number of independent variables associated with the system can be easily obtained from equations. Once the appropriate dimension of the system required for the phase space reconstruction is known, the dynamics of the system is projected into the embedded phase space. Then, the time evolution of the phase space trajectory is analyzed to identify the recurrence behavior of state points on the trajectory. The return of the trajectory to the neighborhood of its previous location in the phase space is considered as the recurrence of the phase space trajectory.

In order to calculate the recurrence behavior of the phase space trajectory, Euclidian distance between each state point on the trajectory is calculated. This distance matrix is then converted into a binary matrix after the choice of an appropriate value for the distance threshold. Whenever the distance between any two state points is less than the threshold, the corresponding state points are considered to have recurred. The recurrence matrix ($R_{i,j}$) of the phase space trajectory is obtained from the following equation, $$R_{i,}=\Theta(\epsilon-\|x_i-x_j\|)$$

where $\Theta$ is the Heaviside theta function such that $\Theta(X<0)=1$ and $\Theta(X>0)=0$. and $x_j$ are state vectors of the phase space trajectory and $\epsilon$ is the recurrence threshold.

Thus, a recurrence plot is constructed by marking the recurrence behavior of the phase space trajectory as 1 and the non-recurrence behavior as 0. Quantitative measures are then obtained by analyzing the arrangement of black points in the recurrence plot. One of the quantitative measures of recurrence behavior of the trajectory is determinism (DET). This measure computes the diagonal alignment of black points in the recurrence plot, which occurs due to the parallel nature of neighboring trajectories in the phase space. The value of DET for any signal is computed through the following equation:

$$DET = \frac{\Sigma_{l=l_{min}}^{N} lP(l)}{\Sigma_{l=1}^{N} lP(l)}$$

Here, $N=n-(d-1)\tau$ is the total number of state vectors of the phase space trajectory, d is the embedding dimension and $\tau$ is the time delay associated with the phase space reconstruction of the dynamic variable. P(l) gives the frequency distribution of the length of the diagonal lines (l) in the phase space. If the two trajectories run parallel to each other all the time, the value of DET nears one and the signals are considered as highly predictable (for example, periodic signals). For noisy signals, the trajectory in the phase space exhibit nearly random maneuvering, and therefore the value of DET appears near zero for such signals.

Several measures based on recurrence quantification analysis such as recurrence rate, entropy, trapping time, average diagonal length, and ratio exist in literature that can be used to detect critical regions in the reaction field of the combustor. Here, DET is used as a representative of all these measures.

c. Calculation of Hurst Exponent (H) from the Velocity Field

The algorithm for finding the critical region is as follows:

The time-series of the velocity-field is represented as $v(x, y; t_i)$, where i=1, 2, . . . , N. For each time instance, we have v(x, y) which is represented by a 2-D matrix of size m×n. We then reshape the matrix into a column vector $[A]_{m\times n,1}$. Finally, we stack the reshaped velocity matrix at successive time instances into the columns of matrix $[A]_{m\times n,N}$. Thus, the rows of matrix [A] contain the spatial information, and columns contains the temporal information. We construct [A] for different flow conditions en-route to the state of thermoacoustic instability.

From the matrix [A], we perform Multifractal Detrended Fluctuation Analysis (MFDFA) of the velocity time series data stored at each spatial location.

Let us represent a row vector containing the time-series of velocity at any given spatial location of [A] as $a_i$, where i=1, 2, . . . , N.

a. Step 1: Determine the fluctuations:

$$Y(i) = \sum_{k=1}^{i}[a_k - \langle a\rangle],\ i = 1, 2, \ldots, N.$$

Here, $\langle a\rangle$ indicates the mean of the signal $a_1$.

b. Step 2: We divide Y(i) into $N_s \equiv \text{int}(N/s)$ non-overlapping segments of equal length s.

c. Step 3: For each of the $N_s$ segments, we calculate the local trend by a least-square fit of the series. We then determine the variance $$F^2(s, v) \equiv \frac{1}{s}\sum_{i=1}^{s}\{Y[(v-1)s+i] - y_v(i)\}^2,$$

for each segment v, v=1, . . . $N_s$. Here, $y_v(i)$ is the type of fitting polynomial in segment v used for detrending the local segments of the data.

d. Step 4: We average over all the segments to obtain the qth order fluctuation function $$F_q(s) = \left\{\frac{1}{2N}\sum_{v=1}^{N_s}\left[F^2(s, v)\right]^{\frac{q}{2}}\right\}^{1/q},$$

where, the index q can take any value except 0. We are interested in finding the value of fluctuations function of the second order, i.e., q=2.

e. Step 5: Finally, we find the dependence of the second order fluctuation function on the scale s. This is represented as $$F_2(s) \sim s^{h(2)},$$

where, h(2) is the Hurst exponent H. The Hurst exponent is related to the fractal dimension of the time series as H=2−D.

Thus, we obtain the Hurst exponent and fractal dimension of the time-series of the velocity value at every given location in the flow-field. Then we reshape the tall (m×n, 1) matrix of H and D value to obtain a field of H and D containing dynamical information regarding the nature of the turbulent flow during different states of thermoacoustic instability.

H measures correlation and persistence in a time-series. If a large value is more likely to be followed by another large value, the signal is said to be persistent. If a large value is more likely to be followed by a small value, the signal is anti-persistent. H defines a continuum of noise-like time series (H=0.5) and a random walk-like time-series (H>1). 0.5<H<1 indicates persistent signal and 0<H<0.5 indicates anti-persistent signal. A time-series with H=1 indicates pink or 1/f-noise characteristics. Such a time-series show long range correlation and the power spectrum scales inversely with frequency. Similarly, time-series possessing 1<H<1.5 indicates random walk with H=1.5 indicating Brownian noise generated from Brownian random walk. The spectrum for such a signal sc ales as $1/f^2$.

d. Detection of Critical Regions in the Combustor Flow Field to Implement Active Control Once, all the aforementioned quantitative measures are evaluated at every point in flow field of the combustor, the regions corresponding to the maximum value of these measures are identified, and these regions are considered as critical regions in the combustor. In order to study the synchronization behaviour of coupled oscillations in the combustor, the turbulent velocity at every point of the combustor (obtained through Particle Image Velocimetry technique) is correlated with the acoustic pressure in the system, and this correlation is identified using PLV. If the time series of these two signals are frequency synchronized, instantaneous phase difference between them oscillates around a constant phase difference, and hence, PLV attains a value close to 1.

On the other hand, if the velocity field oscillates at a different frequency with respect to the acoustic field, the phase difference between the oscillators continuously drifts with time, which is characterized by low values in PLV. Since, DET captures periodic or deterministic nature of oscillations in the system, whenever the turbulence velocity signals in the flow field display periodic characteristics, the value of DET approaches near 1, and these regions of the velocity field are identified as the critical regions. The aperiodic signals possess lower recurrence or deterministic behavior; hence, the value of DET nears 0 for such signals.

Figure 3:
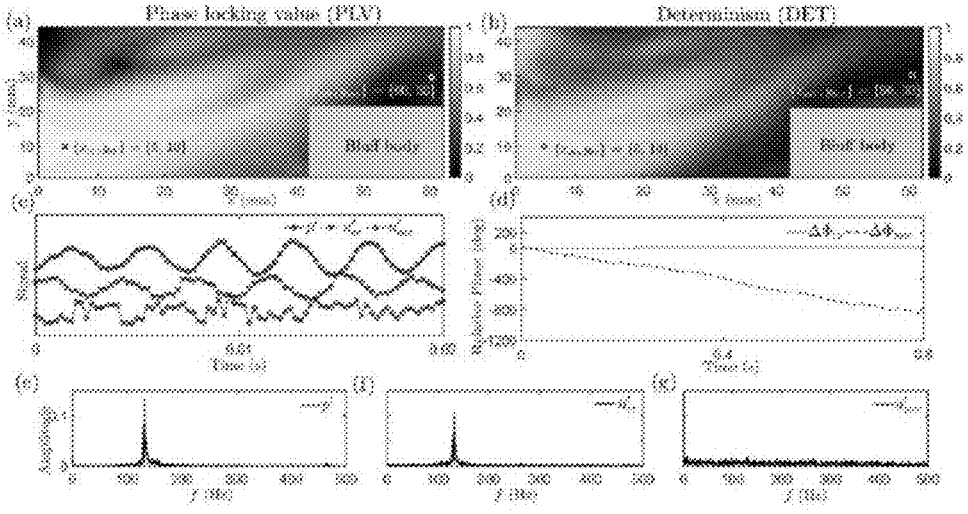
FIG. 3 illustrates a spatial distribution of phase locking value (PLV), and determinism (DET) during the state of thermoacoustic instability in a dump plane, bluff body stabilized combustor, the time series of the acoustic pressure (p') and the velocity fluctuations in the critical ($u_{cv}'$) and the non-critical ($u'_{ncr}$) region and amplitude spectrums corresponding to p', $u_{cv}'$, $u'_{ncr}$ signals, according to embodiments as disclosed herein.

FIG. 3 highlights the critical regions observed in the flow field of a bluff body stabilized turbulent combustor. The synchronization behaviour of local turbulent velocity fluctuations with respect to the global acoustic pressure fluctuations in the combustor is presented in the form of the spatial distribution of PLV between the region of the dump plane and the bluff body (FIG. 3*a*). The deterministic nature of turbulence velocity signals is represented using the distribution of DET in the combustor flow field (FIG. 3*b*). The region close to the bluff body shaft, just downstream of the dump plane, displays maximum PLV and DET and can be referred to as the critical region in the flow field. Moreover, the value of these measures gradually decreases away from the critical region.

FIG. 3*c*-3*g* compare the dynamical behaviour of acoustic pressure (p') and the velocity fluctuations in the critical ($u'_{cr}$) and the non-critical ($u'_{ncr}$) region observed in the flow field, given by $\{x_{cr}, y_{cr}\}=\{5, 10\}$, and $\{x_{cr}, y_{cr}\}=\{60, 30\}$ in FIG. 3*a*, respectively. The velocity signal obtained from the critical region exhibits periodic oscillations, while that obtained from the non-critical region shows aperiodic oscillations (FIG. 3*c*). Further, the velocity signal in the critical region is observed to be frequency synchronized with the pressure signal, having a same dominant frequency at 131.8 Hz (FIG. 3*e,f*). The absence of prominent oscillations for turbulent velocity in the non-critical region results in the occurrence of a flat amplitude spectrum lacking a clear dominant frequency (FIG. 3*g*). The variation of relative phase between pressure and velocity fluctuations in the critical region remains bounded (i.e., the temporal variation of relative phase fluctuates around 90 degrees) and that in the non-critical regions are unbounded (i.e., the phase difference shows a continuous drift in time), refer to FIG. 3*d*.

Figure 4:
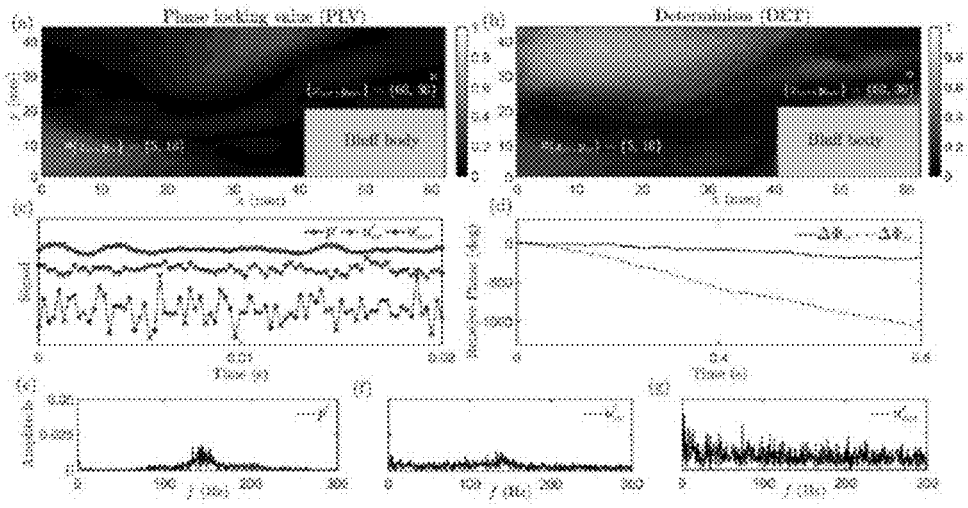
FIG. 4 illustrates a spatial distribution of phase locking value (PLV), and determinism (DET) after the implementation of smart passive control through micro-jet injection in the combustor, a time series of the acoustic pressure (p') and the velocity fluctuations in the critical ($u'_{cr}$) and the non-critical ($u'_{ncr}'$) region and amplitude spectrums corresponding to p', $u'_{cr}$, and $u'_{ncr}$ signals, according to embodiments as disclosed herein.

Once the critical regions are identified, the active control in terms of injection of micro jets of air at these regions of the reaction field is implemented. The micro-jet disrupts the formation of large-scale vortices in the combustor, and thus, aids in the suppression of thermoacoustic instability (FIG. 4). The disruption of critical regions results in a significant drop in the values of PLV and DET in the entire flow field of the combustor, as seen in FIG. 4*a,b*. The dynamics of pressure and turbulent velocity fluctuations appears aperiodic in both the critical and non-critical regions (FIG. 4*c*). It also causes decrease in the magnitude of dominant frequencies in the amplitude spectrum, which can be seen by comparing FIG. 3 *e,f* and FIG. 4*e,f*. The velocity signals are desynchronized with the acoustic pressure, due to destruction of coupling between them in the entire flow field of the combustor (FIG. 4*d*). Hence, the absence of driving in acoustic field reduces the amplitude of acoustic pressure fluctuations in the combustor. Thus, the identification of critical points in the reaction field in the combustor and the application of targeted control through any mechanism (for example, secondary air injection used in the present invention) helps in improving the passive control strategies required for practical combustors.

This control methodology of passive control using secondary air injection is one example among various control strategy, which could be implemented. Any other control methodology that sufficiently alters the flow dynamics at the critical region can also be used for control in an alternate scenario.

During the state of thermoacoustic instability, periodic formation of large-scale coherent vertical structures occurs in the reaction field of the combustor. These vortices directly modulate the flame fronts in the combustor and thereby has a direct correlation with the heat release rate of the flame. Therefore, the localization of the large-scale coherent vertical structures engenders critical regions in the flow field of the combustor. Since the flame-vortex interaction plays an important role in the occurrence of thermoacoustic instability in turbulent combustors, the pockets of localized driving sources in the acoustic field of the combustor needs to be accurately detected and destroyed through appropriate control strategies.

Figure 5:
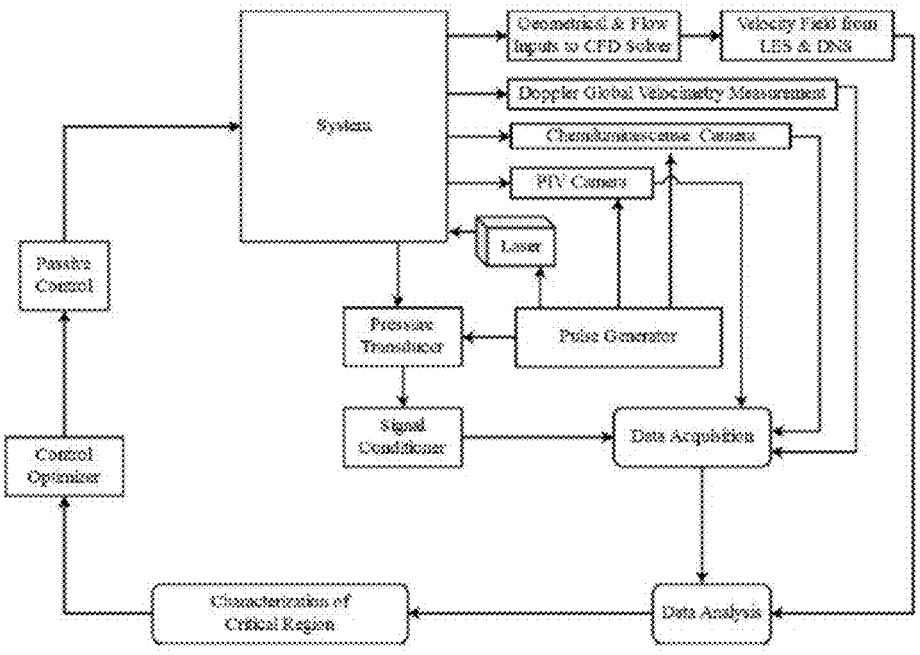
FIG. 5 illustrates a block diagram for the implementation of smart passive control of thermoacoustic oscillations in turbulent combustors, according to embodiments as disclosed herein.
Figure 6:
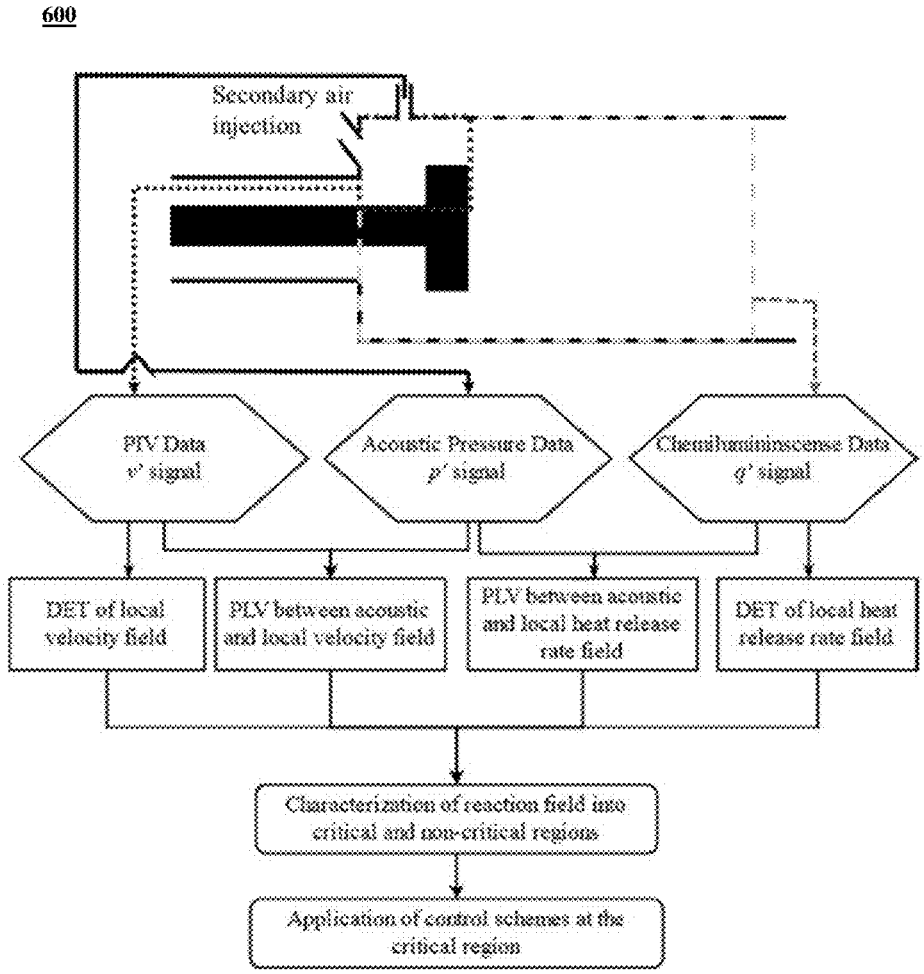
FIG. 6 illustrates a block diagram representing the acquisition and the analysis of the data prior to the implementation of smart passive control in turbulent combustors, according to embodiments as disclosed herein.

FIG. 5 illustrates a block diagram for the implementation of smart passive control of thermoacoustic oscillations in turbulent combustors, according to embodiments as disclosed herein;

FIG. 6 illustrates a block diagram representing the acquisition and the analysis of the data prior to the implementation of smart passive control in turbulent combustors, according to embodiments as disclosed herein.

Figure 7:
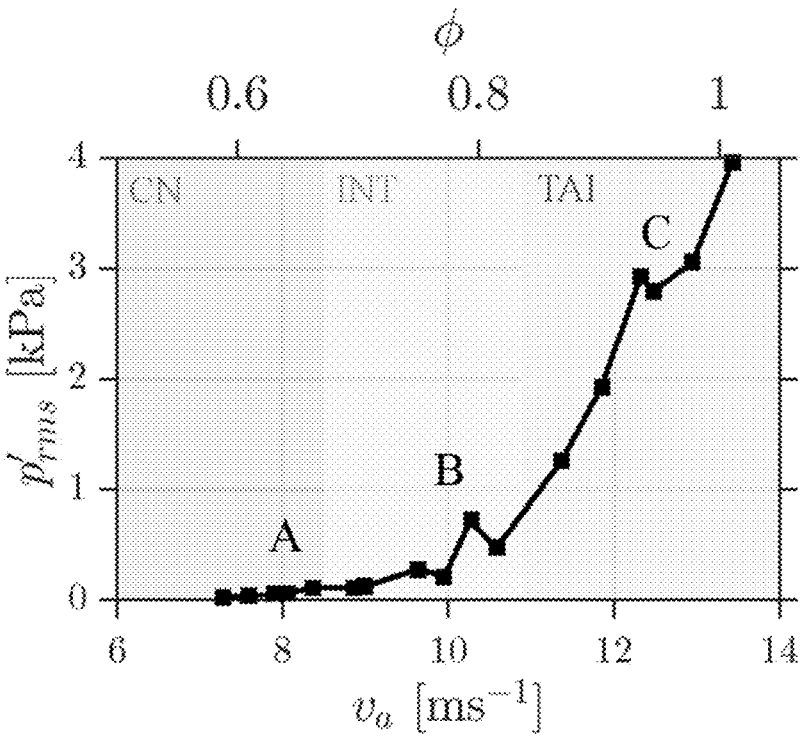
FIG. 7 illustrates the intermittency route to thermoacoustic instability in a bluff-body stabilized combustor, according to embodiments as disclosed herein.

FIG. 7 illustrates the intermittency route to thermoacoustic instability in a bluff-body stabilized combustor, according to embodiments as disclosed herein.

Obtaining the spatial distribution of Hurst exponent (H) for different states of combustor operation shows us the difference in the flow field during combustion noise and thermoacoustic instability. The transition from combustion noise (CN) to thermoacoustic instability (TAI) via the state of intermittency (INT) is shown in FIG. 7.

Figure 8:
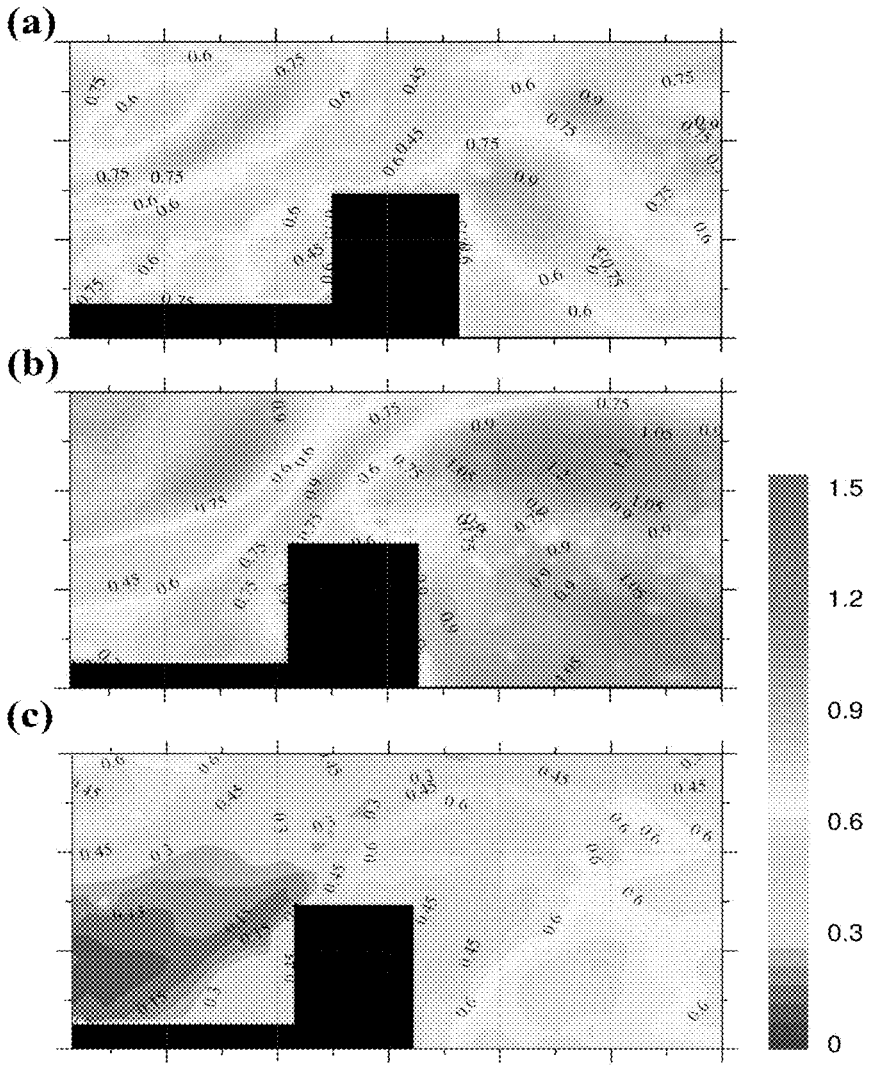
FIG. 8 illustrates the spatial distribution of Hurst exponent measured from snapshots of the velocity field during the state of (a) combustion noise, (b) intermittency and (c) thermoacoustic instability, according to embodiments as disclosed herein.

FIG. 8 illustrates the spatial distribution of Hurst exponent measured from snapshots of the velocity field during the state of (a) combustion noise, (b) intermittency and (c) thermoacoustic instability, according to embodiments as disclosed herein.

The spatial distribution of H for different states of combustor operations, as indicated by markers A-C in FIG. 7, is shown in FIG. 8. FIG. 8*a* shows the distribution of H during combustion noise. It is observed that the value of H is close to 1 throughout the velocity field. Such a distribution indicates that the flow field is persistent and possesses long range correlation. FIG. 8*b* shows the H-distribution during intermittency. Similar to the case of combustion noise, we observe that H is close to one in most of the regions. However, above the shaft of the bluff body and close to the dump plane, there is a decrease in the H value. During thermoacoustic instability (FIG. 8*c*), we notice that there is an expansive region with very low H value. We term this region as the "critical region" based on its importance in controlling the spatio-temporal dynamics of the thermoacoustic system.

Figure 9:
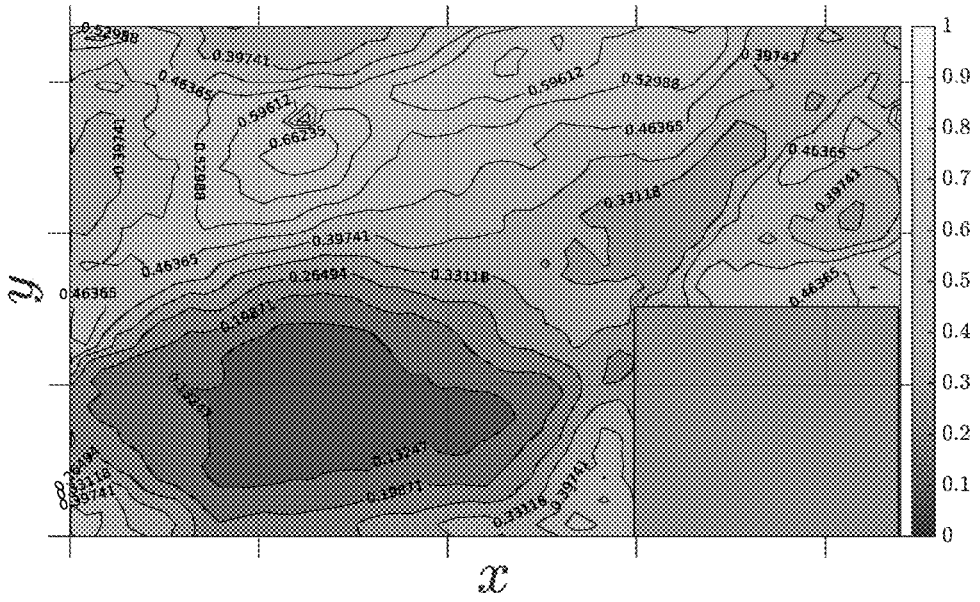
FIG. 9 illustrates the spatial distribution of Hurst exponent during thermoacoustic instability where it is possible to clearly demarcate the region with very low Hurst exponent, according to the embodiments as disclosed herein.

FIG. 9 illustrates the spatial distribution of Hurst exponent during thermoacoustic instability where it is possible to clearly demarcate the region with very low Hurst exponent, according to the embodiments as disclosed herein. We redo the PIV experiments during the state of thermoacoustic instability and focus on the region spanning from the dump plane to the bluff-body and plot the distribution of H in FIG.

9. We can observe that the value of H is indeed very low in this region. We verify the influence of this region on the dynamics of thermoacoustic instability by targeting this region during thermoacoustic instability. We inject secondary air from different inlet ports as shown in FIG. 2. We find that injecting air from the port attached to the dump plane of the combustor leads to maximum suppression. The sound levels decrease to that observed during combustion noise. The pressure time series and amplitude spectrum of thermoacoustic instability is presented in FIG. 10 (top). We observe large amplitude limit cycle oscillations with magnitude as high as 4 kPa. Compare this with the pressure time series obtained during the attempt to control thermoacoustic instability by targeting the critical region shown in FIG. 9 using a secondary jet injection. We observe that the large region with very low H value is disrupted and the resulting flow field has a distribution of H (FIG. 11) which is similar to that observed during combustion noise (FIG. 8*a*).

Figure 10:
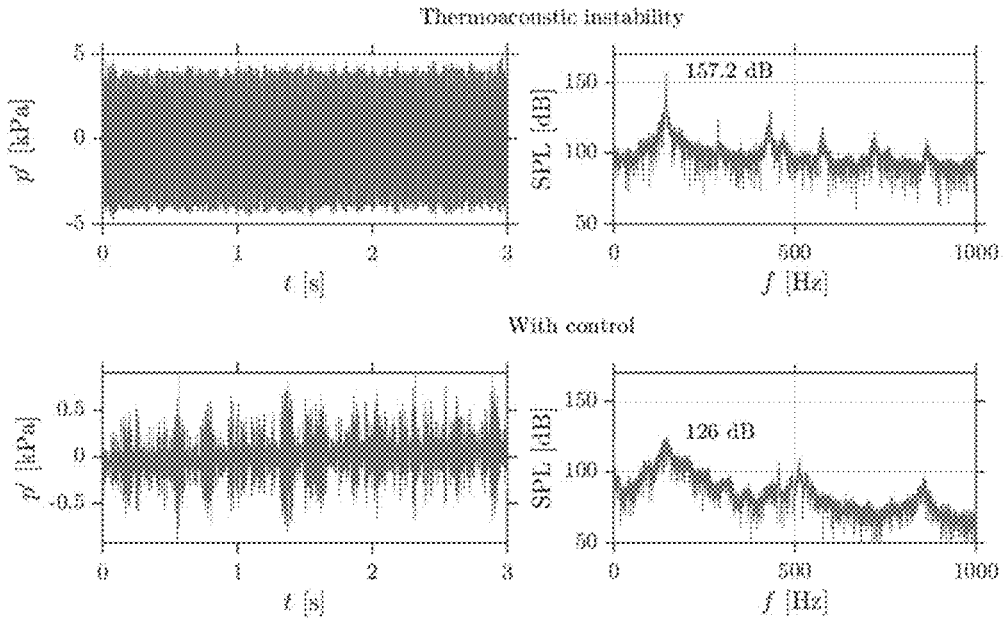
FIG. 10 illustrates the pressure levels during thermoacoustic instability (top) and with secondary injection targeting the critical region (bottom) during the control experiments, according to the embodiments as disclosed herein.
Figure 11:
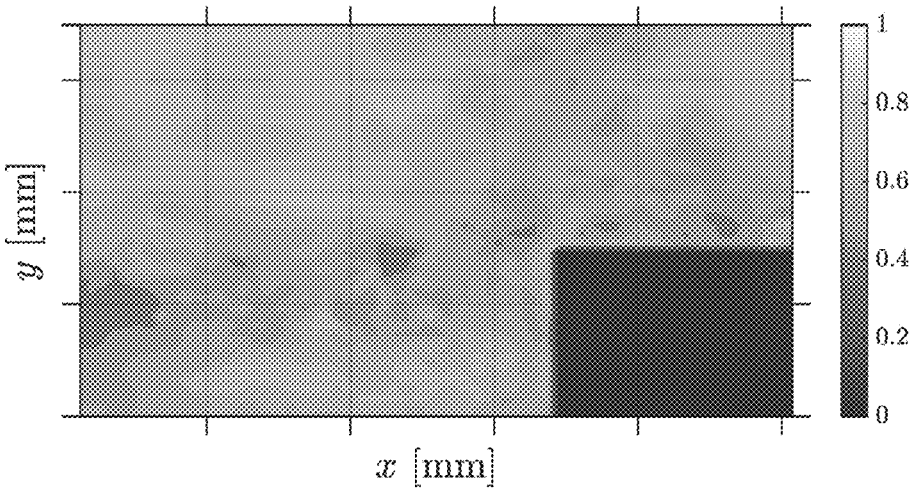
FIG. 11 illustrates the distribution of H when the state of thermoacoustic instability is controlled by targeting the critical region using secondary air, according to the embodiments as disclosed herein.

Secondary air injection leads to greater than 90% suppression in the amplitude of thermoacoustic limit cycle oscillations. In fact, the sound levels during the controlled state are comparable to the sound generated during the state of combustion noise (FIG. 10). Upon quantifying the fractal dimension of this suppressed state (FIG. 11), we find that the field of fractal dimension is similar to that observed during the state of combustion noise (FIG. 8*a*). Secondary air injection at other locations on the combustor wall does not lead to same levels of suppression. Thus, we see that the region identified by the fractal analysis leads to accurate identification of the regions responsible for controlling the dynamics of the thermoacoustic system.

Thus, using the proposed methodology, it is possible to quantify the complex dynamics of the flow field and identify "critical region" in the flow field responsible for the control of the overall dynamics of the thermoacoustic system. Then, using targeted measures such as secondary air injection, we find that we can suppress the amplitude of limit cycle oscillations by 90%.

Figure 12:
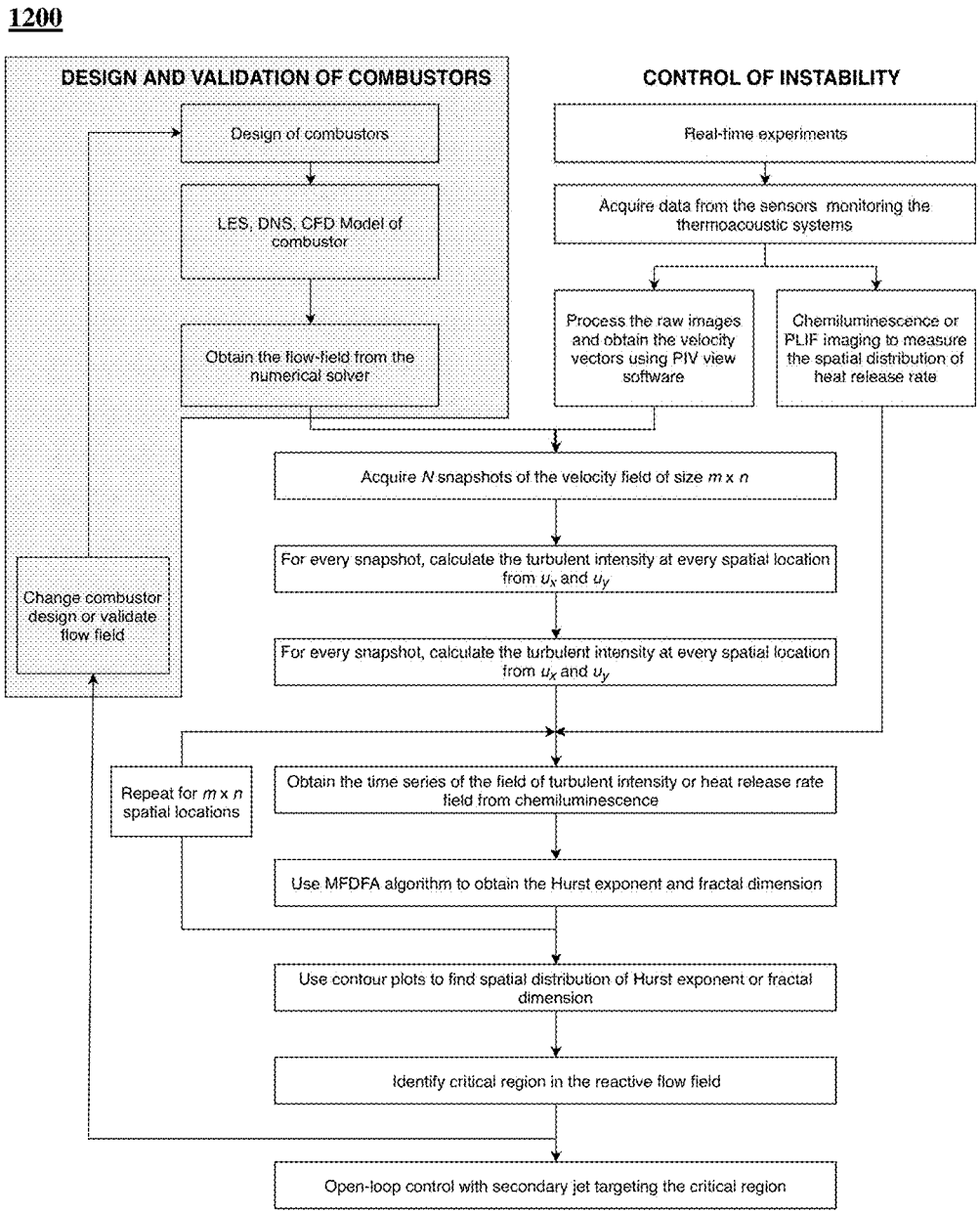
FIG. 12 is a flow diagram illustrating the method of optimizing the open-loop or smart passive control strategy in a turbulent combustor, according to the embodiments as disclosed herein.

FIG. 12 is a flow diagram illustrating the method of optimizing the open-loop or smart passive control strategy in a turbulent combustor, according to the embodiments as disclosed herein.

e. Advantages of the Present Method Compared to Other Studies

In this invention, the fractal analysis is performed on the velocity time-series obtained at every location from the snapshots of velocity field obtained from PIV measurements at different states during the transition to thermoacoustic instability. We identify the so-called "critical regions" in the flow field, which play an important role in controlling the spatio-temporal dynamics of a turbulent thermoacoustic system during the transition to instability. These regions are potentially of diagnostic value and can be used for targeted passive control of thermoacoustic instability.

The proposed methodology have the following advantages over the existing methods:

i. We are able to establish a quantitative measure of identifying regions which are critical in controlling spatio-temporal dynamics of the flow. Thus, we are able to establish a quantitative protocol which can serve as a guiding light while designing combustors. This is in stark contrast to past studies (as mentioned under point 2) where secondary air injections were performed in an ad-hoc manner.

ii. We target the above mentioned critical region using secondary air-injection. We were able to achieve greater than 80% suppression in the amplitude of limit cycle oscillations.

iii. In addition, we also quantify the changes associated with turbulent flow field observed during the transition to thermoacoustic instability. We are able to quantify different regions of the flow field with different flow features from PIV imaging data.

The technical features of the invention which contribute to each of the feature discussed above are:

i. We achieve greater than 80% suppression in the amplitude of limit cycle oscillations (FIG. 10) through the disruption of the critical region, as can be observed from the 'Controlled flow field" in FIG. 11. The sound levels are comparable to that generated during the state of combustion noise.

ii. The proposed method is able to distinguish between different regions with different dynamics. In the state of thermoacoustic instability, the spatial flow field is periodic behind the bluff-body and along the shear layer. Everywhere else, the flow field is aperiodic with different types of dynamics which are also quantified through the present methodology.

Thus, the present methodology can be quite useful in quantifying the dynamics of turbulence in combustors. In general, turbulence measurement requires high resolution spatial or temporal data. Acquiring high resolution spatial and temporal flow field data is especially challenging when combustion is involved. Further, turbulence quantification requires stationary datasets, which are again very difficult to obtain in combustion experiment. The MFDFA used to quantify the velocity field does not rely on such limitations. Measures such as Hurst exponent and fractal dimension are robust and can quantify the dynamics of the flow even when the acquired dataset is non-stationary. Thus, our method is robust in quantifying the different aspects of the turbulent flow field.

Finally, the present methodology can also be used to validate results obtained from CFD simulations such as LES and DNS models of combustors.

As already mentioned, the present methodology does not require long stationary data sets, inexpensive simulations just for a few hundred time-steps would be enough for validation. Depending upon the spatial distribution of Hurst exponent, combustor geometries can be modified during the design stage to avoid the formation of critical regions during the state of thermoacoustic instability.

The present methodology would be useful to the industry in the following ways:

i. Gas turbine industries can use the proposed methodology to avoid combustor designs which may possess such critical region in the industrial combustors that they are developing. The proposed methodology can be used during the design phase in conjunction with CFD and LES to find such regions and the designs can be changed appropriately.

ii. In the already commissioned combustors, gas turbine industries can retroactively make minor modifications to include secondary air injection channels to target the critical regions found from CFD and LES simulations and prevent instances of thermoacoustic instability.

iii. Gas turbine industries can use the proposed methodology to avoid combustor designs which may possess such critical region in the industrial combustors that they are developing. The proposed methodology can be used during the design phase in conjunction with CFD and LES to find such regions and the designs can be changed appropriately.

iv. In the already commissioned combustors, gas turbine industries can retroactively make minor modifications to include secondary air injection channels to target the critical regions found from CFD and LES simulations and prevent instances of thermoacoustic instability.

The present invention can also be extended to other oscillatory instabilities such as aeroacoustic instability or aero-elastic instability. In such cases, the same methodology can be used to find critical regions in the flow and target them to attain control.

The foregoing descriptions of specific embodiments of the present technology have been presented for purposes of illustration and description. They are not intended to be exhaustive or to limit the present technology to the precise forms disclosed, and obviously, many modifications and variations are possible in light of the above teaching. The embodiments were chosen and described in order to best explain the principles of the present technology and its practical application, to thereby enable others skilled in the art to best utilise the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

While several possible embodiments of the invention have been described above and illustrated in some cases, it should be interpreted and understood as to have been presented only by way of illustration and example, but not by limitation. Thus, the breadth and scope of a preferred embodiment should not be limited by any of the above-described exemplary embodiments.

The invention claimed is:

1. A method for suppressing thermo-acoustic instabilities in a combustor, said method comprising:

generating, by a system (100), at least one first signal corresponding to fluctuations in turbulent velocity of the combustor at every location on the plane of the combustor where the flame is stabilized;

generating, by the system (100), at least one second signal corresponding to fluctuations in acoustic pressure of the combustor at least one location of the combustor;

determining, by the system (100), a plurality of phase locked values across the combustor indicative of synchronization of the at least one first signal corresponding to turbulent velocity of the combustor and the at least one second signal corresponding to acoustic pressure of the combustor;

measuring, by the system (100), parameters indicative of a plurality of recurring behavior of fluctuations in turbulent velocity of the combustor at every location of the combustor;

determining, by the system (100), a plurality of Hurst exponent values at every location of the combustor based on the at least one first signal;

detecting, by the system (100), at least one critical region of the combustor, wherein the at least one critical region corresponds to at least one of a maximum value of the plurality of phase locked values, a maximum value of the plurality of recurring fluctuations in turbulent velocity of the combustor at every location of the combustor, and a minimum value of the plurality of Hurst exponent values; and injecting, by the system (100), micro-jets of air at the detected critical regions to suppress thermo-acoustic instabilities.

2. The method of claim 1, wherein determining each of a plurality of phase locked values across the combustor indicative of synchronization of the at least one first signal corresponding to turbulent velocity of the combustor and the at least one second signal corresponding to acoustic pressure of the combustor comprise:

determining an instantaneous phase difference of each of the at least one first signal and the at least one second signal using Hilbert transform; and determining the phase locking value between the at least one first signal and the at least one second signal based on the determined phase difference.

3. The method of claim 2, wherein the plurality of phase locked values across the combustor correspond to a correlation between the turbulent velocity at every location of the combustor with the acoustic pressure of the combustor.

4. The method of claim 2, wherein the phase locked value is characterized by a value close to one when the phase difference is constant and values lower than one when the phase difference continuously drifts with time.

5. The method of claim 1, wherein measuring recurring fluctuations in turbulent velocity of the combustor at every location of the combustor comprises measuring values indicative of recurrence rate, determinism, entropy, trapping time, and average diagonal length.

6. The method of claim 1, wherein the recurring fluctuations are measured by:

measuring a Euclidian distance between state points of the phase space trajectory at every location on the combustor; and determining a recurring fluctuation based on the Euclidian distance being above a threshold.

7. The method of claim 1, wherein determining each of plurality of Hurst exponent values across the combustor is indicative of the scaling behavior of the at least one first signal corresponding to turbulent velocity of the combustor.

8. The method of claim 7, wherein the Hurst exponent value is characterized by a value close to zero for periodic signals and value greater than 0.5 for noisy and fractal signals.

9. The method of claim 1, wherein the at least one critical region of the combustor are detected at a region in the combustor.

10. A system (100) for suppressing thermo-acoustic instabilities in a combustor, the system comprising:

a measuring device (102) configured to generate at least one first signal corresponding to fluctuations in turbulent velocity of the combustor at every location on the plane of the combustor (C) where the flame is stabilized and at least one second signal corresponding to fluctuations in acoustic pressure of the combustor at least one location of the combustor;

a phase locked value generator (112A) configured to determine a plurality of phase locked values across the combustor indicative of synchronization of the at least one first signal corresponding to turbulent velocity of the combustor and the at least one second signal corresponding to acoustic pressure of the combustor;

a determinism unit (112B) configured to measure parameters indicative of a plurality of recurring fluctuations in turbulent velocity of the combustor at every location of the combustor;

a Hurst scaler (112C) configured to determine a plurality of Hurst exponent values at every location of the combustor based on the at least one first signal; and a critical region detector (112) configured to detect at least one critical region of the combustor, wherein the at least one critical region corresponds to at least one of a maximum value of the plurality of phase locked values, a maximum value of the plurality of recurring fluctuations in turbulent velocity of the combustor at every location of the combustor, and a minimum value of the plurality of Hurst exponent values;

wherein micro-jets of air are injected at the detected critical regions to suppress thermo-acoustic instabilities.

11. The system (100) of claim 10, wherein determining each of a plurality of phase locked values across the combustor indicative of synchronization of the at least one first signal corresponding to turbulent velocity of the combustor and the at least one second signal corresponding to acoustic pressure of the combustor comprise:

determining an instantaneous phase difference of each of the at least one first signal and the at least one second signal using Hilbert transform; and determining the phase looking value between the at least one first signal and the at least one second signal based on the determined phase difference.

12. The system (100) of claim 11, wherein the plurality of phase locked values across the combustor correspond to a correlation between the turbulent velocity at every location of the combustor with the acoustic pressure of the combustor.

13. The system (100) of claim 11, wherein the phase locked value is characterized by a value close to one when the phase difference is constant and values lower than one when the phase difference continuously drifts with time.

14. The system (100) of claim 10, wherein measuring recurring fluctuations in turbulent velocity of the combustor at every location of the combustor comprises measuring values indicative of recurrence rate, entropy, trapping time, and average diagonal length.

15. The system (100) of claim 11, wherein the recurring fluctuations are measured by:

measuring a Euclidian distance between state points of the phase space trajectory at every location on the combustor; and determining a recurring fluctuation based on the Euclidian distance being above a threshold.

16. The system (100) of claim 10, wherein determining each of plurality of Hurst exponent values across the combustor is indicative of the scaling behavior of the at least one first signal corresponding to turbulent velocity of the combustor.

17. The system (100) of claim 10, wherein the Hurst exponent value is characterized by a value close to zero for periodic signals and value greater than 0.5 for noisy and fractal signals.

18. The system (100) of claim 10, wherein the at least one critical region of the combustor are detected at a region in the combustor.

* * * * *